US005188172A

United States Patent [19]

Blount et al.

[11] Patent Number: 5,188,172

[45] Date of Patent: Feb. 23, 1993

[54] AUTOMATIC DOWNHOLE WELL SHUT-IN CONTROL VALVE

[75] Inventors: Curtis G. Blount, Wasilla; John C. Braden, Anchorage, both of Ak.

[73] Assignee: Atlantic Richfield Company, Los Angeles, Calif.

[21] Appl. No.: 752,706

[22] Filed: Aug. 30, 1991

[51] Int. Cl.[5] ..... E21B 34/08; E21B 49/00

[52] U.S. Cl. ..... 166/64; 166/66.4; 166/323

[58] Field of Search ..... 166/250, 373, 64, 65.1, 166/66.4, 323, 325, 238

[56] References Cited

U.S. PATENT DOCUMENTS 2,245,712 6/1941 Ragan ..... 166/66.4
2,948,339 8/1960 Fredd ..... 166/238 X
4,878,053 10/1989 Rorden et al. ..... 166/66.4 X
4,896,722 1/1990 Upchurch ..... 166/250

*Primary Examiner*—William P. Neuder
*Attorney, Agent, or Firm*—Michael E. Martin

[57] ABSTRACT

An automatic timed shut-in valve for pressure transient testing of a well and the like includes a body member adapted for connection to a locking device for locating the valve at a predetermined point in a tubing string. The valve includes a clock timer and an actuator which is operable to close the valve at a predetermined time after insertion of the valve in the tubing string. Various operations may be carried out including automatic times shut-in of a well or pressure transient testing by recording at least one of pressure and temperature in the well in timed relationship to actuation of the valve so that wellbore and formation conditions can be measured upon shut-in of the well.

4 Claims, 2 Drawing Sheets

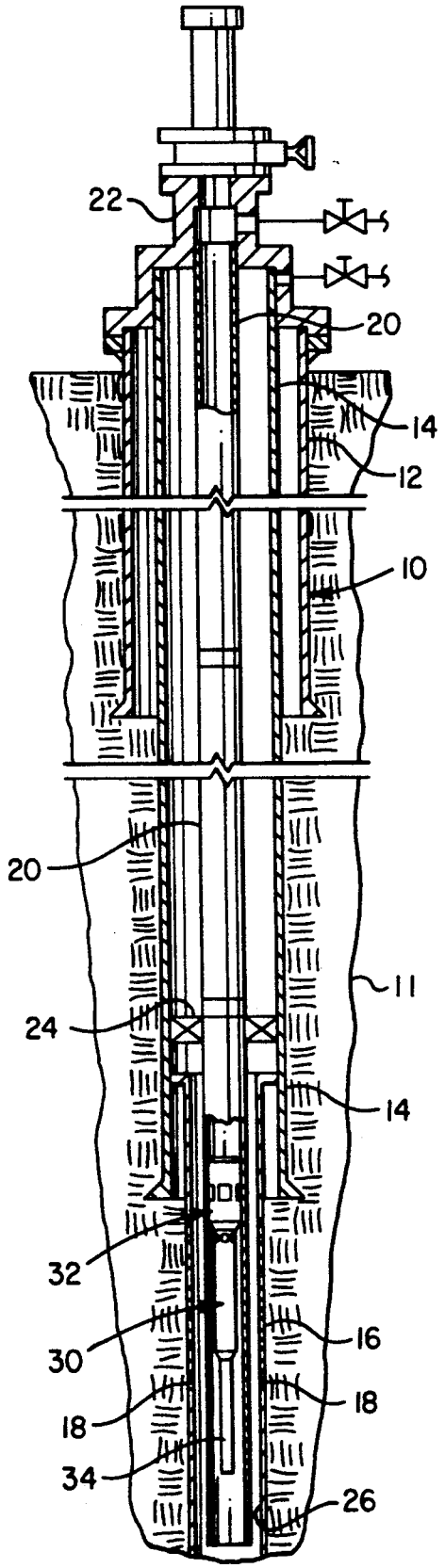
FIG. 1
FIG. 3
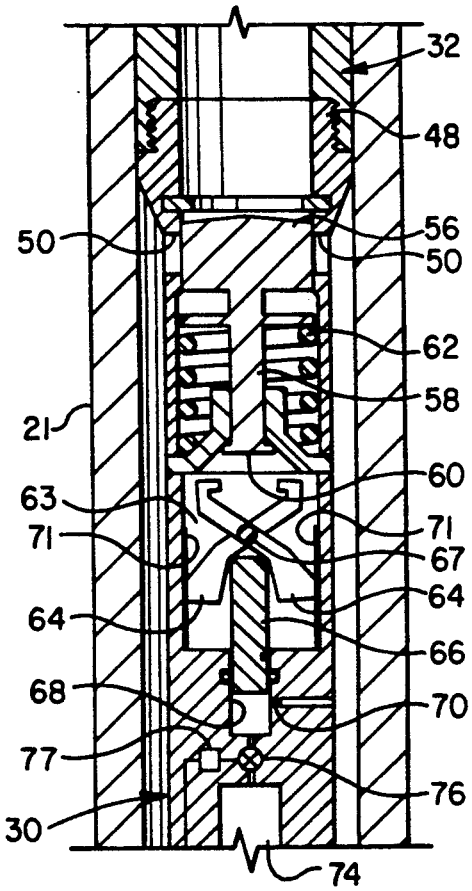

FIG. 2A
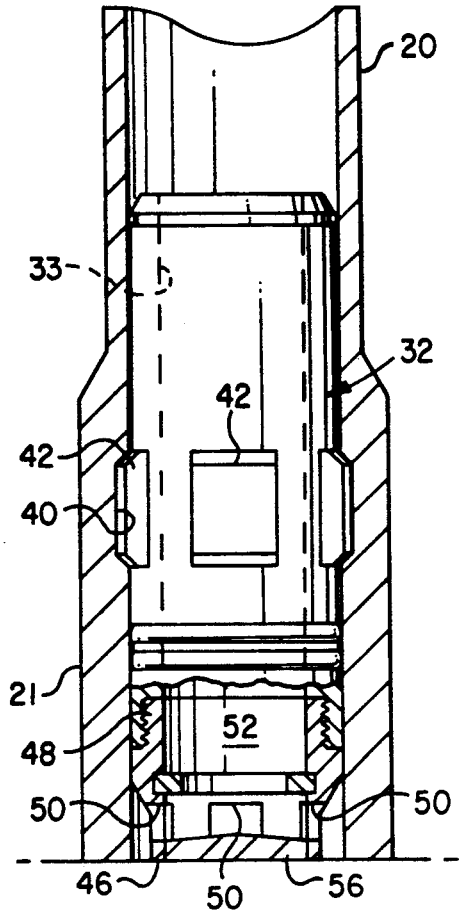
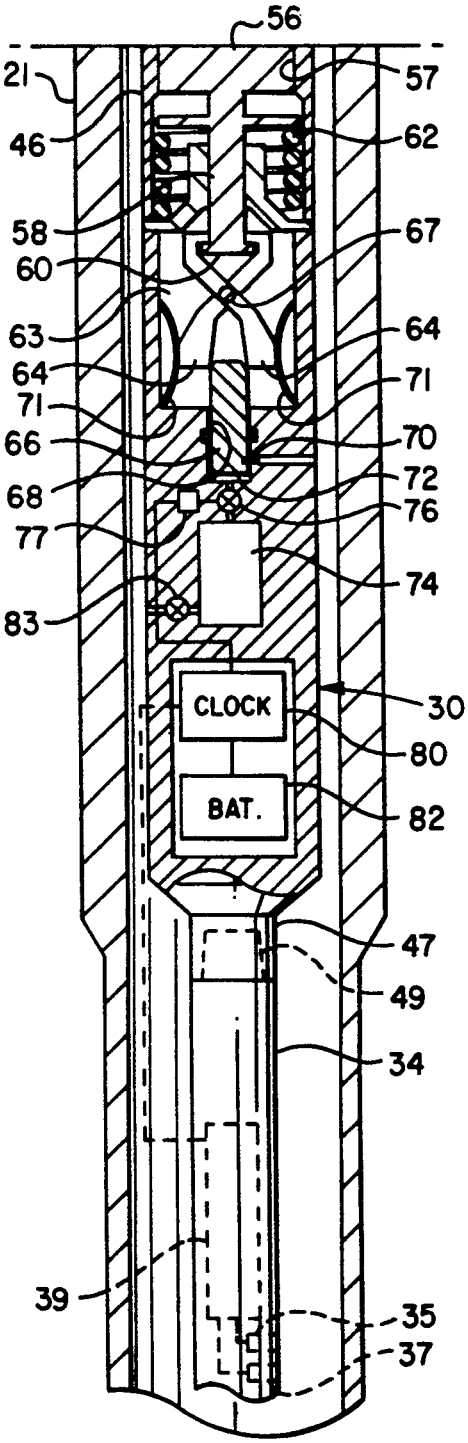
FIG. 2B
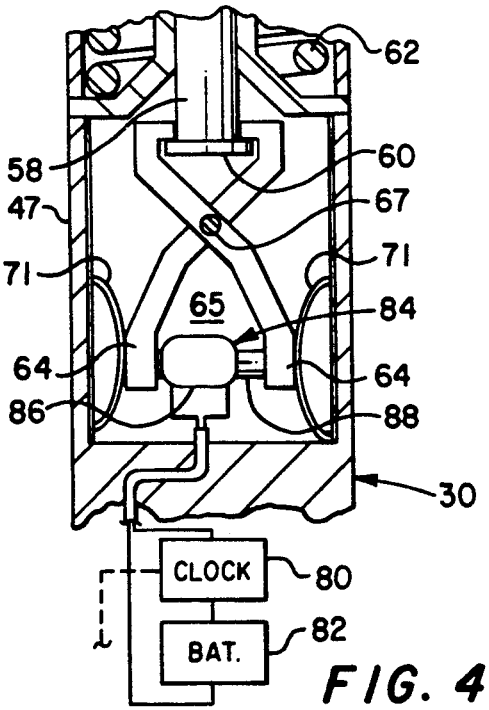
FIG. 4

AUTOMATIC DOWNHOLE WELL SHUT-IN CONTROL VALVE

BACKGROUND OF THE INVENTION

1. Field of the Invention

The present invention pertains to a downhole shut-in control valve which is automatically actuated at a predetermined time for performing certain wellbore tests and other operations requiring timed shut-in of well fluid flow.

2. Background

In certain wellbore tests, such as pressure transient testing of formation characteristics and well fluid flow, it is desirable to use a downhole shut in device to shut off well fluid flow to minimize the effects of wellbore storage and afterflow which are generally caused by compressive and/or thermal energy or by a changing liquid level in the well tubing. The shut in device should also be capable of operating at a predetermined time to carry out the test procedure and without interruption of fluid flow prior to the initiation of the test. Conventional wellbore shut-in valve devices require wireline or slickline connection to the valve itself to run the device and set it and then to perform the valve closure operation. In many instances, a separate trip into the wellbore is required to effect setting or operation of the valve which can disrupt wellbore fluid flow and pressure thereby delaying the wellbore test or producing false test readings.

Accordingly, it is desirable to be able to provide a wellbore shut-in valve which will operate at a predetermined time without interruption of other wellbore operations upon placement of the valve in a predetermined location in a fluid-conducting tubing string. Such a valve may also be used to isolate flow from commingled streams which are separated by a locking nipple. The present invention provides an improved wellbore shut-in tool or flow control valve having the desired features and providing for the improved test operations mentioned above.

SUMMARY OF THE INVENTION

The present invention provides an automatic downhole shut-in or flow control valve for use in a production or injection well for automatically shutting off wellbore fluid flow through a tubing string at a predetermined time. In accordance with an important aspect of the present invention, a wellbore shut-in tool or flow control valve is provided which is self-contained and includes a closure member which is automatically actuated in response to operation of a mechanical or electrical timing device or clock to shut-in the well. The flow control valve is advantageously used in conjunction with downhole wellbore or formation condition sensors, including pressure and/or temperature sensors which are operable to be placed in the wellbore above or below the valve for making certain well condition measurements.

Those skilled in the art will recognize the above-described advantages and superior features of the present invention, together with other important aspects thereof, upon reading the detailed description which follows in conjunction with the drawing.

BRIEF DESCRIPTION OF THE DRAWING

FIG. 1 is a vertical section view of a fluid production well showing an installation of the automated shut-in control valve in accordance with the present invention;

FIGS. 2A and 2B comprise a section view showing the features of one preferred embodiment of the control valve of the present invention;

FIG. 3 is a detail section view showing the valve in its actuated or closed position; and FIG. 4 is a detail section view of an alternate embodiment of the valve actuator.

DESCRIPTION OF PREFERRED EMBODIMENTS

In the description which follows, like parts are marked throughout the specification and drawing with the same reference numerals, respectively. The drawing figures are not necessarily to scale, and certain features are shown in generalized or somewhat schematic form in the interest of clarity and conciseness.

Referring to FIG. 1, there is illustrated a conventional fluid production well, generally designated by the numeral 10, which has been drilled into an earth formation 11. The well 10 is of conventional construction, including a surface pipe or casing 12, an intermediate casing 14, a production casing or liner 16 having suitable perforations 18 formed therein, and a production tubing string 20 extending through the casing strings from a conventional wellhead 22. The production tubing string 20 extends through a seal or packer 24 to define a wellbore space 26 in which production fluids are operable to be conveyed to the surface through the tubing string 20.

In order to test certain fluid reservoir conditions within the formation 11, it is sometimes desirable to be able to shut off production fluid flow or the flow of fluid being injected into the well, as the case may be, at a predetermined time followed by certain operations such as recording of pressure and temperature conditions in the wellbore space 26 in the zone of interest in the formation into which the perforations 18 open. In this regard, a shut-in or flow control valve is desirably placed in the production tubing string 20 in the position indicated in FIG. 1 and is herein designated generally by the numeral 30. The shut-in valve 30 is adapted to be interposed in the tubing string 20 at a predetermined location by a support and locking device 32 which may be conveyed into the wellbore on a slickline cable or the like or, in deviated or high flow rate wells, on a coilable tubing string, not shown. It is also desirable to place certain test instruments in the wellbore below the valve 30 and preferably connected directly to the body of the valve. In FIG. 1, a test instrument is illustrated and generally designated by the numeral 34 connected to the lower end of the valve 30.

An important advantage of the present invention is realized with the ability to place the valve 30 and its support and locking device 32 together with the instrument 34 in a predetermined position in the wellbore whereupon the coilable tubing or slickline, not shown, may be removed from the wellbore and the valve then automatically actuated at a predetermined time to shut off fluid flow through the tubing string 20 to the wellhead 22. Certain measurements and the operation of measurement devices may also be more accurately timed to begin upon the timed closure of the shut-in valve to save instrument battery power and reduce the number of necessary measurements.

Referring now to FIGS. 2A and 2B, there is illustrated a preferred embodiment of the valve 30 in its working position in the tubing string 20. The tubing string 20 is preferably provided with a suitable landing nipple portion 21, including receptacle means 40 for engaging the lock members 42 of the locking device 32. The locking device 32 may be of a type commercially available, such as from Otis Engineering Company, Dallas, Tex. or the Baker Packers Division of Baker-Hughes Company, Houston, Tex. The locking device 32 is suitably connected to the shut-in valve 30, which is provided with a generally elongated cylindrical body member 46, adapted to be connected at its upper end 48 to the locking device 32 in a conventional manner, as illustrated. The body member 46 includes a plurality of circumferentially spaced, generally rectangular flow ports 50 formed therein and opening into a passage 52 formed in the body member. The passage 52 is in communication with a corresponding, generally central longitudinal passage 33 formed in the locking device 32.

A cylindrical piston or so-called poppet type closure member 56 is slidably disposed in a bore 57 formed in the body member 46 and includes a generally coaxial depending stem portion 58 having a flange 60 formed on the distal end thereof. The closure member 56 is operable to be disposed in a valve-open position against the bias of a closure spring 62 disposed in the body member 46. A pair of opposed latch members 64 are supported in the body member 46 by pivot means 67 for engagement with the flange 60, as shown, to hold the closure member 56 in its open position against the bias of the spring 62. The latch members 64 are also engagable by a piston 66 disposed in a bore 68 formed in the body member 46 and retained in the position illustrated in FIG. 2B by a shear pin 70. The piston 66 has a lower end face 72 which is operable to be exposed to pressure fluid such as nitrogen gas stored in a chamber 74 formed in the body 46. A valve 76 is interposed between the chamber 74 and the bore 66 and has a motor operator 77 operable, when electrically energized, to open the valve whereby high pressure gas forces the piston 66 to shear the pin 70 and move upwardly, viewing FIG. 2B, in the body member 46 to pivot the latch members 64 to release the closure member 56 for closure of the ports 50.

As illustrated in FIG. 2B, the latch members 64 are urged into the positions illustrated for engagement with the flange 60 by opposed bow springs 71 disposed in a cavity 63 in the housing 46 in which the latch members 64 are also disposed.

The valve operator 77 is suitably electrically connected to a clock 80 disposed in the body member 46. A source of electrical energy, such as a battery 82, is also operably connected to the clock 80 for operating the clock and for providing suitable electrical energy to the valve operator 77. The clock 80 has suitable mechanism for closing a switch, not shown, which may comprise part of the clock and which is operable to energize the operator 77. As further illustrated in FIG. 2B, the instrument 34 is suitably connected to the lower end 47 of the body member 46 by a conventional threaded connection 49.

The actuating mechanism for the closure member 56 is exemplary, and those skilled in the art will appreciate that various other actuating devices, including the alternate embodiment described below, may be used which are operable in response to a clock or timer signal to effect movement of the closure member 56 to move to the closed position illustrated in FIG. 3 upon release of the stem 58 by the latch members 64.

The instrument 34 may be of a type commercially available, such as that manufactured by Panex Corporation as one of their Model 1500 Series Downhole Digital Pressure/Temperature Probes. The instrument 34 may, for example, include temperature and pressure sensors 35 and 37 suitably connected to a recording device 39, all of which may be activated by the clock 80 in conjunction with activation of the valve operator 77 or in some timed relationship thereto.

Deployment of the assembly of the locking device 32, the valve 30 and the instrument 34 into the well 10 may be carried out in a conventional manner. The clock 80 is preferably started in its timing function prior to placement of the assembly of the locking device 32, valve 30 and instrument 34 in the wellbore. Alternatively, the clock or timer 80 may be started through a remote signal from a wireline cable or the like or some other electrical signal transmitted through the tubing string 20, for example. Prior to timing out of the clock 80, certain wellbore fluid flow rates can be controlled, as desired, by allowing the flow of fluid through the tubing string 20, the ports 50 and the passage 52 in the desired direction. Temperature and pressure conditions within the tubing string 20 and at the location of the instrument 34 may, if desired, be recorded prior to activation of the valve 56.

Upon timing out of the clock 80, an electrical signal may be sent to the operator 77 to effect discharge of pressure gas from the chamber 74 with enough force on piston 66 to shear the pin 70 and displace the piston sufficiently to effect release of the stem 58 of the closure member 56 thereby allowing the closure member to rapidly move to the position illustrated in FIG. 3 to close the ports 50. The instrument 34 may, of course, be controlled by the clock 80 to commence or continue to record the pressure and temperature conditions existing at the sensors 35 and 37 after closure of the valve 30. In due course, the assembly of the locking device 32, the valve 30 and the instrument 34 may be retrieved in a conventional manner using a wireline or tubing conveyed retrieval device using techniques known to those skilled in the art. The shear pin 70 may be replaced and the chamber 74 recharged with pressure gas through a suitable fill valve 83, FIG. 2B. Conventional materials and components used for wellbore fluid flow control devices may be used to fabricate the valve 30.

Referring now to FIG. 4, there is illustrated an alternate embodiment of an actuator mechanism for actuating the pivot arms 64 to release the closure member stem 58. A modified body member 47 is provided for the valve 30 which includes a cavity 65 in which the arms 64 are pivotally supported and biased into the position shown by the opposed bow springs 71. The arms 64 are engaged with a solenoid-type actuator 84 which includes a suitable coil or winding 86 and a plunger 88 operably supported by the arms 64 and, upon energization of the winding 86, operable to pivot the arms to release the stem 58 for movement of the closure member to the closed position shown in FIG. 3. The solenoid actuator 84 is suitably connected to the clock and the battery 82 in such a way that upon timing out of the clock 80 a switch will close to energize the actuator and, of course, also if desired, commence operation of the instrument 34.

Although preferred embodiments of the present invention have been described in detail herein, those skilled in the art will recognize that various substitutions and modifications may be made to the valve and its actuator device without departing from the scope and spirit of the invention as recited in the appended claims.

What is claimed is:

1. A fluid control valve for disposition in a well to shut off the flow of fluid within said well at a predetermined time, sad valve comprising:

a body member including means defining fluid flow port means therein;

a piston type closure member disposed in said body member and movable between an open position and a closed position covering said port means, said closure member being movable to close over said port means under the urging of a biasing spring disposed in said body member;

actuator means for moving said closure member between open and closed positions, said actuator means including latch means for latching said closure member in an open position and movable to release said closure member to move to a valve-closed position under the urging of said biasing spring; and clock means for effecting operation of said actuator means at a predetermined time.

2. The valve set forth in claim 1 wherein:

said actuator means includes a piston disposed in said body member, means forming a chamber for retaining a charge of pressure fluid in said chamber and valve means operable to discharge pressure fluid against said piston means for causing said latch means to release said closure member to move said valve closed position.

3. The valve set forth in claim 1 wherein:

said actuator means includes a solenoid actuator operable to move said latch means to release said closure member to move to said valve closed position.

4. A fluid flow control valve for disposition in a well to shut off the flow of fluid within said well at a predetermined time, said valve comprising:

a body member including means defining fluid flow port means therein;

a closure member disposed in said body member and movable between an open position and a closed position covering said port means;

biasing means for biasing said closure member to move to said closed position;

actuator means including latch means for latching said closure member in an open position, said actuator means being movable to release said closure member to move to a closed position under the urging of said biasing means;

means responsive to an electrical signal to cause said latch means to release said closure member for movement under the urging of said biasing means from an open position to said closed position; and clock means for causing said electrical signal to effect the operation of said actuator means at a predetermined time to cause said closure member to shut off the flow of fluid through said port means from a predetermined part of said well.

* * * * *